US005310413A

United States Patent [19]

Hallinan

[11] Patent Number: 5,310,413

[45] Date of Patent: May 10, 1994

[54] PROCESS AND APPARATUS FOR EXTRACTION OF METAL VALUES FROM METAL BEARING ORES

[75] Inventor: Mark S. Hallinan, Johannesburg, South Africa

[73] Assignee: African Oxygen Limited, Johannesburg, South Africa

[21] Appl. No.: 895,299

[22] Filed: Jun. 8, 1992

[30] Foreign Application Priority Data

Jun. 6, 1991 [ZA] South Africa ..... 91/4336

[51] Int. Cl.[5] ..... C22B 3/12

[52] U.S. Cl. ..... 75/744; 423/29; 266/170

[58] Field of Search ..... 423/29; 266/170; 75/744

[56] References Cited

U.S. PATENT DOCUMENTS 5,071,477 12/1991 Thomas et al. ..... 75/744

*Primary Examiner*—Melvyn J. Andrews

*Attorney, Agent, or Firm*—Larry R. Cassett

[57] ABSTRACT

The invention relates to the extraction of metal values from metal bearing ores. More specifically, the invention comprises, in a process 10 for extracting metal values from metal bearing ores, a method of enhancing metal value recovery from the ore. The method comprises introducing, upstream of a metal recovery section 26, a gaseous agent by means of arrangements 30. The gaseous agent is capable of promoting recovery of metal values from the ore. The gaseous agent introduction is into at least one of the pipelines 20, 24, 28 conveying ore slurry or process water for use in slurry ore or for slurry make-up. The gaseous agent introduction is effected at a plurality of spaced points or zones, with the proviso that when at least one of the points or zones is in a slurry pipeline between a hydrocyclone separator and a thickener in the leaching stage, or in a water return pipeline from such a thickener to a mill, then at least one further gaseous agent introduction point or zone is provided in a pipeline downstream of such thickener.

16 Claims, 2 Drawing Sheets

PROCESS AND APPARATUS FOR EXTRACTION OF METAL VALUES FROM METAL BEARING ORES

TECHNICAL FIELD

This invention relates to the extraction of metal values from metal bearing ores.

BACKGROUND OF THE PRIOR ART

The Applicant is aware of a process for extracting metal values from metal bearing ores which comprises, in a milling stage, milling wetted ore to produce a slurry; adding a lixiviant to the slurry from the milling stage; passing the slurry to a leaching stage where the lixiviant leaches metal from the ores, with the metal thus being dissolved in the lixiviant; passing the leached slurry to a carbon-in-pulp ('CIP') absorption section where the slurry is contacted with activated carbon particles which absorb the metal from the lixiviant; separating the carbon particles from the residual slurry; and, in a metal recovery section, recovering the metal from the carbon particles. Instead of the separate leaching and absorption stages, a combined leaching and carbon absorption ('CIL') stage can be provided. The slurry conveyance to the various stages, as well as within each stage from one item of processing equipment to the next, is effected along pipelines, some of which are fitted with pumps. Similarly, process water required for slurrying or pulping ore, e.g. slurry make-up water, is also conveyed along pipelines, some of which can be fitted with pumps. Such a process is hereinafter also referred to as a 'process of the kind described'.

SUMMARY OF THE INVENTION

According to one aspect the invention, there is provided, in a process of the kind described for extracting metal values from metal-bearing ores, a method of enhancing metal value recovery from the ore, which comprises introducing, upstream of the metal recovery section, a gaseous agent capable of promoting recovery of the metal values from the ore, into at least one of the pipelines conveying ore slurry or process water for use in slurrying ore or for slurry make-up, with the gaseous agent introduction being effected at a plurality of spaced points or zones, provided that when at least one of the points or zones is in a slurry pipeline between a hydrocyclone separator and a thickener in the leaching stage, or in a water return pipeline from such a thickener to a mill, then at least one further gaseous agent introduction point or zone is provided in a pipeline downstream of such thickener.

The method may be a noble metal, particularly gold, so that the ore is gold-bearing ore, and the lixiviant may be a cyanide-based substance such as an alkali metal cyanide, e.g. calcium or sodium cyanide. The gaseous agent may then be oxygen gas or an oxygen-enriched gas.

Sufficient gas may be introduced collectively at all the zones/points to ensure that the dissolved oxygen levels in the slurry are maintained at values higher than the saturation level of oxygen in slurry open to atmosphere. The gas introduction may be effected by injecting the gas into the pipelines, and the injection rate may be between 0.1 and 0.2 oxygen per tonne of ore.

The points or zones may be spaced apart along a single pipeline. Instead, or additionally, they may be spaced apart circumferentially around the pipeline. They may also be located between stages, e.g. one or more of the points or zones may be provided upstream of the leaching stage, one or more thereof between the leaching the CIP stages, and/or one or more thereof downstream of the CIP stage. Where a pipeline is provided with a pump, at least one of the points or zones may be provided upstream of the pump and/or between the pump stages. However, it is believed that if the gas is injected into a pump suction conduit, particularly efficient and intimate oxygen/slurry mixing will be obtained, so that only one injection point or zone may suffice.

Thus, according to another aspect of the invention, there is provided, in a process of the kind described for extracting metal values from metal-bearing ores, a method of enhancing metal value recovery from the ore, which comprises introducing, upstream of the metal recovery section, a gaseous agent capable of promoting recovery of the metal values from the ore, into at least one of the pipelines conveying ore slurry or process water for use in slurrying ore or slurry make-up, with the gaseous agent introduction being effected at at least one point or zone in a pump section conduit.

The gaseous agent introduction may be effected by injection as hereinbefore described. The injection may be at a single point or zone in the suction conduit if the pump is capable of handling the desired oxygen flow without experiencing cavitation problems. Instead, the injection may be effected at a number of spaced points or zones if a pump cannot handle the full oxygen flow when injected into the pump suction, as hereinbefore described.

BRIEF DESCRIPTION OF THE DRAWINGS

The invention will now be described by way of example with reference to the accompanying diagrammatic drawings.

In the drawings.

DETAILED DESCRIPTION OF THE INVENTION

Figure 1:
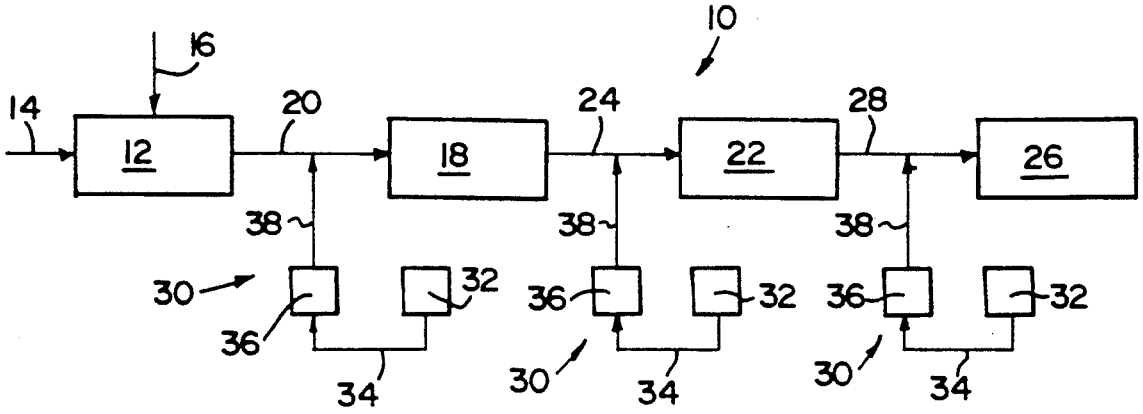
FIG. 1 shows a simplified flow diagram of a process for extracting gold from gold-bearing ore, in accordance with a first embodiment of the invention.

Referring to FIG. 1, reference numeral 10 generally indicates a process for extracting gold from gold-bearing ore, in accordance with one embodiment of the invention.

The process 10 includes a milling stage 12, with flow lines 14, 16 leading into the stage 12. It also includes a leaching stage 18, with a flow line 20 leading from the stage 12 to the stage 18. A CIP stage 22 is located downstream of the leaching stage 18 and is connected thereto by means of a flow line 24. A gold recovery stage 26 is located downstream of the stage 22 and is connected thereto by means of a flow line 28. It is to be appreciated that each of the flow lines 14, 20, 24 and 28 can comprise one or more pipelines, while, within each of the stages 12, 18 and 22 one or more pipelines may interconnect various items of processing and ancillary equipment.

The process 10 also includes at least one oxygen injection arrangement, generally indicated by reference numeral 30. Typically, the arrangement 30 is provided between the stages 12, 18 and comprises an oxygen storage vessel 32, such as a pressurized oxygen cylinder, a pipeline 34 leading from the vessel to a control panel 36 for regulating the flow of oxygen from the vessel 32, and a conduit 38 leading from the control panel to the pipeline or flow line 20, as described in more detail hereunder with reference to FIGS. 3 to 5. Instead of, or in addition to, being provided between the stages 12, 18, the oxygen injection arrangement 30 can be provided between the stages 18, 22 and/or between the stages 22, 26. Thus, such an oxygen injection arrangement can be provided between all three pairs of stages as shown in FIG. 1. Instead, one or more of the arrangements 30 can be provided for injecting oxygen into a process water pipeline (not shown) supplying water for slurrying, e.g. slurry make-up water.

The milling stage 12 typically comprises at least one mill for milling wet ore entering it along the flow line 14 into a slurry. A lixiviant, typically calcium cyanide, enters the milling stage 12 along a flow line 16, and is admixed with the slurry in the milling stage. Typically, sufficient calcium cyanide is added to the milled ore, slurry or pulp so that it is present therein at a concentration of about 100–400 ppm (by mass). It is to be appreciated that the lixiviant can instead, or additionally, be added to the slurry downstream of the milling stage.

The slurry or pulp from the stage 12 passes along the pipeline 20, to a leaching stage 18. The leading stage 18 typically comprises at least one thickener and a series of pachucas or vessels in which the calcium cyanide can act on the gold-bearing ore to extract gold from the ore. Calcium cyanide containing water, separated from the slurry in the stage 18, is then returned to the milling stage 12 (not shown).

Slurry from the stage 18, containing the gold-bearing calcium cyanide, then passes to the stage 22 where it is contacted in known fashion with activated carbon or charcoal particles, typically in a series of vessels, in order to adsorb gold from the calcium cyanide onto the activated charcoal particles. The activated charcoal particles are separated from the residual slurry, with the residual slurry then being processed further in known fashion. The gold-bearing activated charcoal particles pass along the flow line 28 to the gold recovery section 26 where the gold is recovered from the activated charcoal particles in known fashion.

By means of the oxygen injection arrangements 30, air or oxygen is injected into the various slurry streams. This increases the dissolved oxygen levels in the milled pulp. The Applicant believes that this will lead to increased gold value recoveries due to more complete gold dissolution in the calcium cyanide taking place, particularly if the process or plant 10 is running on greater than designed throughputs, or if the plant throughput is to be increased.

Furthermore, oxygen in the pulp or slurry is also consumed by unoxidized minerals and organics which are present int he ore. In their unoxidized state, these species react with calcium cyanide, rendering it unavailable for gold dissolution so that excess calcium cyanide must thus be added to the pulp to compensate for this, leading to increased cyanide consumption. The oxygen injection, as hereinbefore described, will thus, it is believed, also lead to a decrease in cyanide consumption.

The oxygen injection arrangements 30 and their points of introduction into the pipelines are preferably selected such that the oxygen can be introduced into the conduits in turbulent zones and under pressure, since pressurized oxygen injection will enhance oxygen dissolution in the slurry, while turbulent flow conditions will ensure that the gaseous bubbles of oxygen are well dispersed in the slurry in the pipeline. The injection means should also be located at such positions that there is sufficient residence time in the process downstream of the injection means to allow the oxygen to dissolve before it can escape to atmosphere, e.g. in open vessels.

Furthermore, by increasing the oxygen levels in the slurry by the oxygen injection arrangements, the reaction of gold with the calcium cyanide as hereinbefore described, takes place at a faster rate so that, apart from being able to increase plant throughput as hereinbefore described, the residence time of the gold in the process can be reduced. This has the advantage that the contact time of the carbonaceous material with the gold is reduced, lessening the re-absorption of the gold onto the carbonaceous material, thereby also enhancing gold recovery, i.e. rendering it more efficient.

A further advantage of the oxygen injection provided by the present invention is that gold-bearing ores also contain iron pyrites minerals which also react with cyanide, i.e. consume calcium cyanide. Oxygen oxides these minerals to form iron hydroxides, which form as a cyanide-immune layer on the iron pyrites particles, thereby also reducing calcium cyanide consumption.

With the multistage oxygen injection and/or oxygen injection into pump suctions in accordance with the present invention, it is thus believed that formation of small oxygen bubbles in the pipelines is promoted, resulting in high oxygen transfer efficiencies, leading to optimized oxygen usage with accompanying cost benefits. An additional benefit may be the reduction in oxygen demand in the leaching stage, due to the increased or higher oxygen levels in the feed slurry, which are, as described, obtainable with the present invention.

Figure 2:
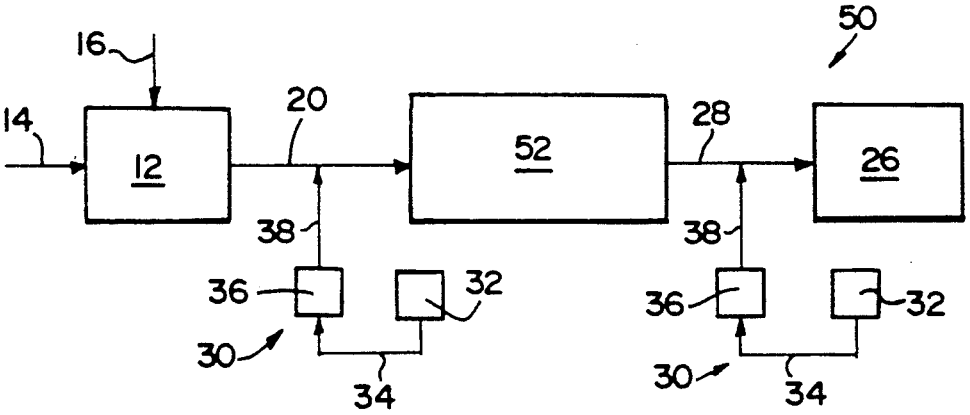
FIG. 2 shows a simplified flow diagram of a process for extracting gold from gold-bearing ore, in accordance with a second embodiment of the invention.

Referring to FIG. 2, reference numeral 50 generally indicates a process for recovering gold from gold-bearing ore, according to another embodiment of the invention.

Parts of the process 50 which are the same or similar to those of the process 10 hereinbefore described with reference to FIG. 1, are indicated with the same reference numerals.

Instead of having the separate leaching stage 18 and CIP stage 22, the process 50 has a composite CIL stage 52 where essentially the same slurry processing steps that are effected in the separate stages 18, 22 of the process 10, are effected.

In the process 50, one of the oxygen injection arrangements 30 is provided between the stages 12, 52. Instead, it can be provided between the stages 52, 26. Still further, one such arrangement can be provided between each of the stages 12, 52 and 52, 26.

Figure 3:
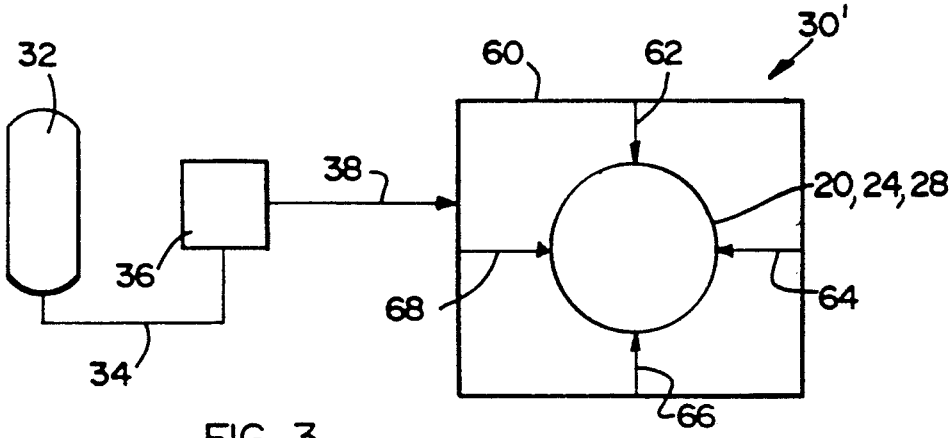
FIG. 3 shows a more detailed flow diagram of one of the oxygen injection arrangements of FIGS. 1 and 2, this arrangement being in accordance with one embodiment of the invention.

Referring to FIG. 3, reference numeral 30' generally indicates one of the oxygen injection arrangements of FIGS. 1 and 2, according to one embodiment of the invention.

The conduit 38 of the arrangement 30' leads into a ring conduit 60 from which leads inwardly to the pipe 20, 24 or 28, branches 62, 64, 66 and 68. The branches are thus, at their points of entry into the pipeline, spaced circumferentially apart, and are typically spaced 90° apart. A greater or lesser number of branches can be provided if desired. Furthermore, instead of having the ring conduit 60, the gas flow through the individual branches may be individually controlled.

Each of the branches 62, 64, 66 and 68 is provided with a suitable oxygen injection device for injecting oxygen into the slurry flowing along the pipeline. In one embodiment of the invention, the oxygen injecting device may comprise a sonic nozzle by means of which oxygen at a pressure of 300–500 kPa is released through the nozzle at a velocity approaching the speed of sound, into the pipeline. The point or zone of injection is then preferably at an elbow in the conduit so that fluid turbulence is maximized and, as mentioned above, a sufficient distance from the next downstream vessel which is open to atmosphere, to allow the oxygen to dissolve. Ideally, the velocity of the slurry in the pipeline should be between 2 and 5 meters per second for good dispersion of the oxygen bubbles. For example, the injection means may then be that available under the trade name PRIMOX.

Preferably, sufficient oxygen is injected so that dissolved oxygen levels in the slurry in the pipeline are maintained above saturation level of oxygen in slurry at a point where the slurry is open to atmosphere, in a downstream open vessel. The actual rate of oxygen injection will thus depend on the efficiency of dissolution, the oxygen consumption by the slurry, and the oxygen saturation levels in the slurry, but typically the collective injection rates can be 0.1–0.2 kg of oxygen per tonne of ore milled.

Figure 4:
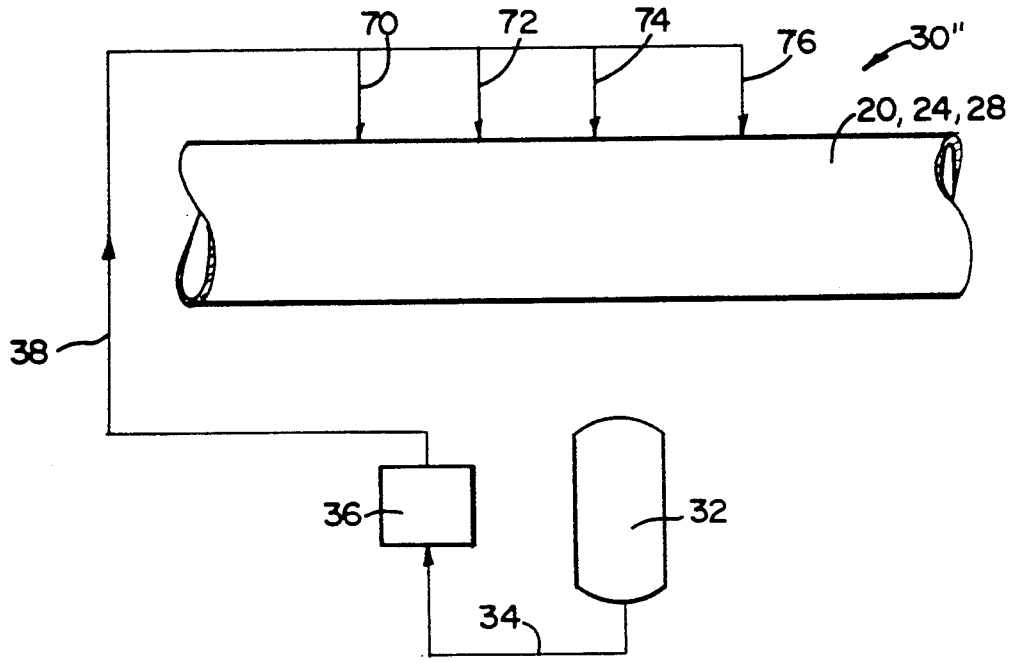
FIG. 4 shows a more detailed simplified flow diagram of one of the oxygen injection arrangements of FIGS. 1 and 2, in accordance with another embodiment of the invention.

Referring to FIG. 4, reference numeral 30" generally indicates, in more detail, one of the oxygen injection arrangements of FIGS. 1 and 2.

In the arrangement 30", the conduit 38 leading from the control panel 36 to the pipeline 20, 24 or 28 splits into branches 70, 72, 74 and 76 which are located at spaced points or zones along the pipeline. In other words, the branches 70, 72, 74 and 76 are spaced apart longitudinally along the pipe. Each of the branches is provided with an oxygen injection device as hereinbefore described. Furthermore, each of the branches may be provided with branches 62, 64, 66 and 68 as well as, optionally, a ring conduit 60, as hereinbefore described with reference to FIG. 3. Each branch 70, 72, 74 and 76 may instead have its own oxygen storage vessel and control panel.

Figure 5:
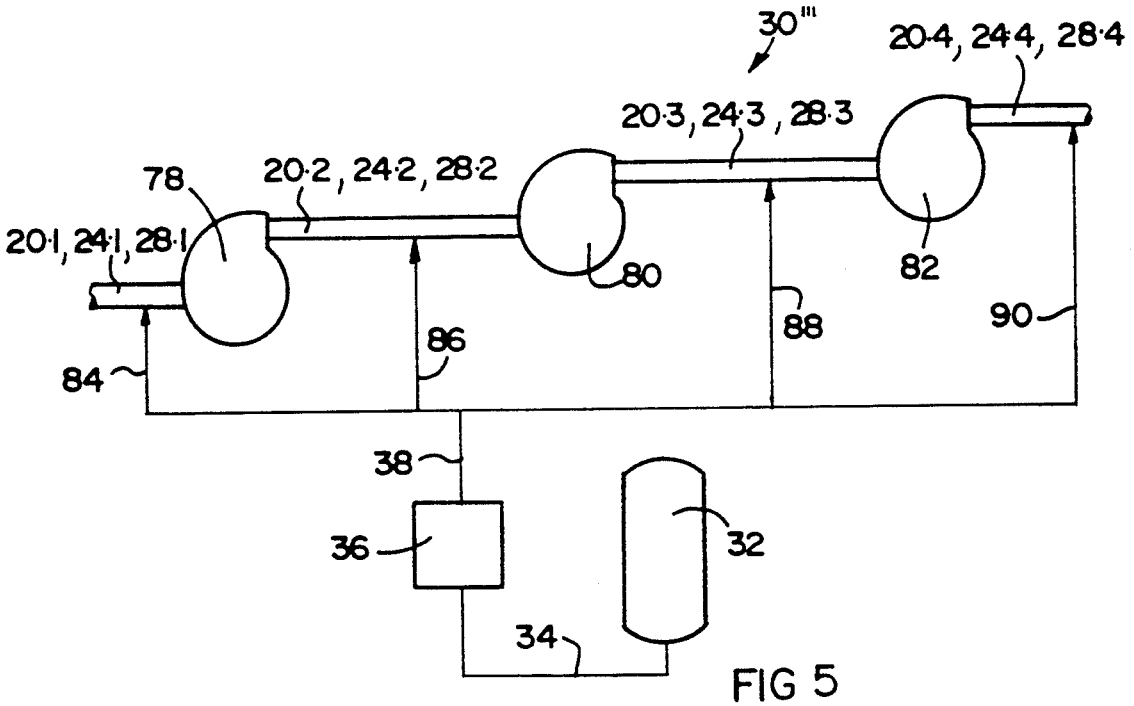
FIG. 5 also shows a more detailed flow diagram of one of the oxygen injection arrangements of FIGS. 1 and 2, according to yet another embodiment of the invention.

Referring to FIG. 5, reference numeral 30''' generally indicates one of the oxygen arrangements of FIGS. 1 and 2, according to another embodiment of the invention.

The conduit 30 of the arrangement 30''' again splits into branches 84, 86, 88, 90. However, in this case the branches 84, 86, 88, 90 each lead to a portion of the pipeline between different stages 78, 80, 82 etc. of a multistage pump. Instead, 78, 80, 82 can indicate individual pumps in a pump train.

When a first pump stage or a first pump in a pump train obtains its feed from a tank or vessel, e.g. a water tank, oxygen gas or oxygen-bearing gas can be sparged into water in the tank or injected int a conduit leading from the tank to the pump, as hereinbefore described. Furthermore, in view of the intimate mixing obtained when injecting the gas into the suction side of a pump or pump stage, it may be possible to dispense with all but one of the branches 84, 86, 88, 90, provided that the pump or pump stage into whose suction the sole gas injection zone or point is provided, is capable of handling the desired oxygen load with cavitation problems.

It is further to be appreciated that each of the branches 84, 86, 88, 90 may be provided with branches 70, 72, 74 and 76 as hereinbefore described with reference to FIG. 4, or with a ring conduit 60 and branches 62, 64, 66, 68 as described hereunder with reference to FIG. 3.

I claim:

1. A process for extracting metal values from an ore bearing a desired metal, which comprises the following steps:

(a) milling an ore containing the desired metal in the presence of water from at least one first pipeline to produce an ore containing slurry;
(b) adding a lixiviant to the slurry;
(c) dissolving the desired metal in the lixiviant to thereby leach the desired metal from the slurry;
(d) absorbing the dissolved metal from the lixiviant with activated carbon particles in a carbon-in-pulp absorption section;
(e) separating the carbon particles from the slurry;
(f) recovering the desired metal from the carbon particles;
(g) wherein the slurry is conveyed along second pipelines, some of which can be fitted with pumps to each succeeding step of the process; and wherein the improvement comprises introducing, prior to step (f), and after the formation of the ore-containing slurry in step (a), a gaseous agent, capable of promoting recovery of the metal values from the ore, into at least one of the second pipelines or the first pipeline said agent being introduced at a plurality of spaced apart points or zones of at least one of said first and second pipelines, provided that when at least one of the spaced apart points or zones is in a second pipeline between step (e) and step (c), or in a first pipeline from step (c) to step (a), then at least one further gaseous agent introduction point or zone is provided in one of said first or second pipelines slurry or process water which is positioned downstream after step (c).

2. The process of claim 1 wherein the metal is a noble metal.

3. The process of claim 2, wherein the noble metal is gold

4. The process of claim 1, wherein the lixiviant is cyanide-based.

5. The process of claim 4, wherein the cyanide-based lixiviant is calcium cyanide or sodium cyanide.

6. The process of claim 5, wherein calcium cyanide is added to obtain a concentration of about 200 ppm by mass.

7. The process of claim 1, wherein the gaseous agent is oxygen or an oxygen-containing gas, wherein oxygen is dissolved in the slurry directly when oxygen or the oxygen-containing gas is introduced into the second pipeline, or in the slurry indirectly when the oxygen or oxygen-containing gas is introduced into the first pipeline.

8. The process of claim 7, wherein a sufficient amount of the gaseous agent is introduced collectively to the process to ensure that the dissolved oxygen in the slurry prior to step (f) is maintained at values higher than the saturation level of oxygen in a slurry opened to the atmosphere.

9. The process of claim 7, wherein the introduction of the gaseous agent is between 0.1 and 0.2 kilograms oxygen per ton or ore.

10. The process of claim 1, wherein the points are spaced apart along a single pipeline.

11. The process of claim 1, comprising introducing the gaseous agent circumferentially around the first or second pipeline through said spaced apart points.

12. The process of claim 1, wherein the points are located between one or more steps of the process.

13. The process of claim 7, wherein the oxygen or oxygen-containing gas is injected via an oxygen injecting device comprising a sonic nozzle with a release pressure of 300–500 kPa and adapted to inject said gas at a velocity approaching the speed of sound.

14. The process of claim 7, wherein the oxygen or oxygen-containing gas is injected such that fluid turbulence is maximized and at sufficient distance from the next downstream vessel which is opened to the atmosphere to allow the oxygen to dissolve.

15. The process of claim 14, in which the velocity of the slurry is between 2 and 5 meters per second.

16. An apparatus for extracting metal values from an ore bearing a desired metal, which comprises:

(a) a mill for wetted ore to produce an ore containing slurry;
(b) means for adding a lixiviant to the slurry;
(c) metal leaching means for dissolving the desired metal in the lixiviant;
(d) a carbon-in-pulp absorption section containing an absorber for absorbing the dissolved metal from the lixiviant with activated carbon particles;
(e) a separator for removing the carbon particles with metal from the slurry;
(f) a recovery means for removing the metal from the carbon particles; and
(g) first and second pipelines, at least one of said first and second pipelines having a plurality of spaced apart points or zones, some of which can be fitted with pumps for conveying process water required for slurrying and for conveying the slurry; and wherein the improvement comprises means for introducing, into at least one of said first and second pipelines prior to the recovery means, at a plurality of said spaced apart points or zones, a gaseous agent, which agent is capable of promoting recovery of the metal values from the ore, wherein the metal is gold, the lixiviant is calcium cyanide, and the agent is oxygen or an oxygen-containing gas, provided that when at least one of the points or zones is in a second pipeline between components (e) and (c), or in a first pipeline from components (c) and (a), then at least one further gaseous agent introduction point or zone is provided in a first or second pipeline located after component (c).

* * * * *